US008387589B2

(12) United States Patent
Wong et al.

(10) Patent No.: US 8,387,589 B2
(45) Date of Patent: Mar. 5, 2013

(54) POSITION SENSOR FOR AN OUTPUT SHAFT USED IN A SHIFT AND THROTTLE SYSTEM

(75) Inventors: Ray Tat Lung Wong, Richmond (CA); Neil Garfield Allyn, Vancouver (CA)

(73) Assignee: Marine Canada Acqusition Inc., Richmond (CA)

( * ) Notice: Subject to any disclaimer, the term of this patent is extended or adjusted under 35 U.S.C. 154(b) by 397 days.

(21) Appl. No.: 12/704,480

(22) Filed: Feb. 11, 2010

(65) Prior Publication Data

US 2011/0041800 A1 Feb. 24, 2011

Related U.S. Application Data

(60) Provisional application No. 61/173,946, filed on Apr. 29, 2009.

(51) Int. Cl.
*F02B 77/08* (2006.01)
*F02B 77/14* (2006.01)

(52) U.S. Cl. ..... 123/319; 123/612

(58) Field of Classification Search ..... 123/319, 123/612, 617, 406.58; 701/21, 41, 400; 440/1, 440/84, 86
See application file for complete search history.

(56) References Cited

U.S. PATENT DOCUMENTS

| | | | | |
|---|---|---|---|---|
| 4,071,818 | A | 1/1978 | Krisst | |
| 4,350,041 | A | 9/1982 | Loker et al. | |
| 4,898,132 | A | 2/1990 | Kanno | |
| 4,950,988 | A | 8/1990 | Garshelis | |
| 5,228,548 | A | 7/1993 | Bohlin | |
| 6,587,765 | B1 | 7/2003 | Graham et al. | |
| 6,595,179 | B1 | 7/2003 | Kanno | |
| 6,823,745 | B2 | 11/2004 | Goto et al. | |
| 6,871,555 | B2 | 3/2005 | May | |
| 7,131,339 | B2 | 11/2006 | Kwun et al. | |
| 7,133,758 | B2 | 11/2006 | Otto et al. | |
| 7,142,955 | B1 | 11/2006 | Kern et al. | |
| 7,179,143 | B2 | 2/2007 | Mizuguchi et al. | |
| 7,330,782 | B2 | 2/2008 | Graham et al. | |
| 7,335,070 | B2 | 2/2008 | Yoda et al. | |
| 7,384,321 | B2 | 6/2008 | Muramatsu et al. | |
| 7,469,604 | B2 | 12/2008 | Hedayat et al. | |
| 2004/0090195 | A1 | 5/2004 | Motsenbocker | |
| 2004/0181322 | A1 * | 9/2004 | Okuyama | 701/21 |
| 2005/0014427 | A1 * | 1/2005 | Yoda et al. | 440/86 |
| 2005/0170715 | A1 * | 8/2005 | Yoda et al. | 440/75 |
| 2006/0166573 | A1 | 7/2006 | Vetta et al. | |
| 2006/0202680 | A1 * | 9/2006 | Schmidt et al. | 324/207.12 |
| 2007/0227268 | A1 | 10/2007 | Ouyang et al. | |
| 2008/0216589 | A1 | 9/2008 | Shimizu | |

OTHER PUBLICATIONS

AS5045 12 Bit Programmable Magnetic Rotary Encoder, www.austriamicrosystems.com, 2008.
AS5000 Series Magnetic Sensor Circuits, Magnet Selection Guide, www.austriamicrosystems.com, 2008.
BRP Evinrude Icon Interactive Control System Press Release, Feb. 12, 2009, Bombardier Recreational Products Inc., Miami, Florida.

* cited by examiner

*Primary Examiner* — Mahmoud Gimie
(74) *Attorney, Agent, or Firm* — Cameron IP

(57) ABSTRACT

A rotary actuator comprises a housing with an output shaft extending from the housing. There is a magnet disposed on the output shaft and the output shaft is coupled to an actuator arm. A motor rotates the output shaft. A position sensor mounted on a circuit board determines the position of the output shaft based on the position of the magnet. A position of the actuator arm may be determined based on the rotating position of the output shaft.

23 Claims, 8 Drawing Sheets

POSITION SENSOR FOR AN OUTPUT SHAFT USED IN A SHIFT AND THROTTLE SYSTEM

CROSS-REFERENCE TO RELATED APPLICATION

This application claims the benefit of provisional application No. 61/173,946 filed in the United States Patent and Trademark Office on Apr. 29, 2009, the full disclosure of which is incorporated herein by reference and priority to which is claimed.

BACKGROUND OF THE INVENTION

1. Field of the Invention

The present invention relates to a position sensor for an output shaft and, in particular, to a position sensor for an output shaft of a rotary actuator used in a shift and throttle system for marine vessel.

2. Description of the Related Art

It is well known to provide marine vessels with electronic shift and throttle systems to remotely control shift and throttle functions of a propulsion engine such as an outboard or inboard engine. In such systems it is desirable to know the position of a shift arm and/or throttle arm to prevent damage to the engine and assist in shifting. This is typically done using a position sensor which signals the position of the arm to a control circuit. To minimize differences between the actual position of the arm and the position of the arm sensed by the position sensor it is generally required that the position sensor be disposed within or adjacent to the actuator which actuates the arm.

For example, U.S. Pat. No. 7,335,070 issued on Feb. 26, 2008 to Yoda et al. and the full disclosure of which is incorporated herein by reference, discloses an remote control shift and throttle system comprising a shift actuator mounted an outboard engine. The shift actuator has a motor which rotates a worm gear which, in turn, engages a spur gear mechanism thereby imparting rotation to an output shaft. One of the spur gears in the spur gear mechanism is integrated with a potentiometer. Said one of the spur gears is also coupled to a microswitch which is wired to a control circuit. Together the potentiometer and microswitch function as a position sensor for sensing the position of a shift arm which is driven by the output shaft.

When the shift arm is in a neutral position, the spur gear engages the microswitch in a manner such that the microswitch is switched on. The microswitch signals a control circuit allowing the engine to be started by a starter switch. The potentiometer detects rotation of the spur gear as the shift arm is moved from the neutral position to either the shift forward position or shift reverse position. The motor is stopped by the control circuit when the potentiometer detects that the shift arm has moved to the shift forward position. Similarly, the motor is stopped by the control circuit when the potentiometer detects that the shift arm has moved to the shift reverse position. Stopping the motor when the shift arm is in either the shift forward or shift reverse position prevents the shift arm from breaking as a result of a high voltage being applied to the motor in the event of an electrical malfunction.

SUMMARY OF THE INVENTION

It is an object of the present invention to provide an improved position sensor for sensing a rotating position of an output shaft of a rotary actuator used in a shift and throttle system for a marine vessel.

There is accordingly provided a rotary actuator comprising a housing with an output shaft extending from the housing. There is a magnet disposed on the output shaft and the output shaft is coupled to an actuator arm. A motor rotates the output shaft. A sensor mounted on a circuit board determines a rotational position of the output shaft based on the position of the magnet. A position of the actuator arm may be determined based on the rotating position of the output shaft. The rotary actuator may function as a shift actuator or a throttle actuator.

In a preferred embodiment of the invention the rotary actuator comprises a housing with an output shaft extending from the housing. An actuator arm is coupled to the output shaft and a magnet is disposed at an end of the output shaft opposite the actuator arm. A motor which is coupled to the output shaft rotates the output shaft. A position sensor senses a rotational position of the magnet as the output shaft rotates. The position sensor is electrically coupled to a sensor circuit and the sensor circuit determines a rotational position of the output shaft. A position of the actuator arm may be determined based on the rotational position of the output shaft. The sensor circuit is preferably mounted on a printed circuit board.

Determining the position of the actuator arm based on the rotating position of the output shaft reduces, or may even eliminate, backlash which may occur when the position of linked components such as gears are used to determine the position of the actuator arm.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
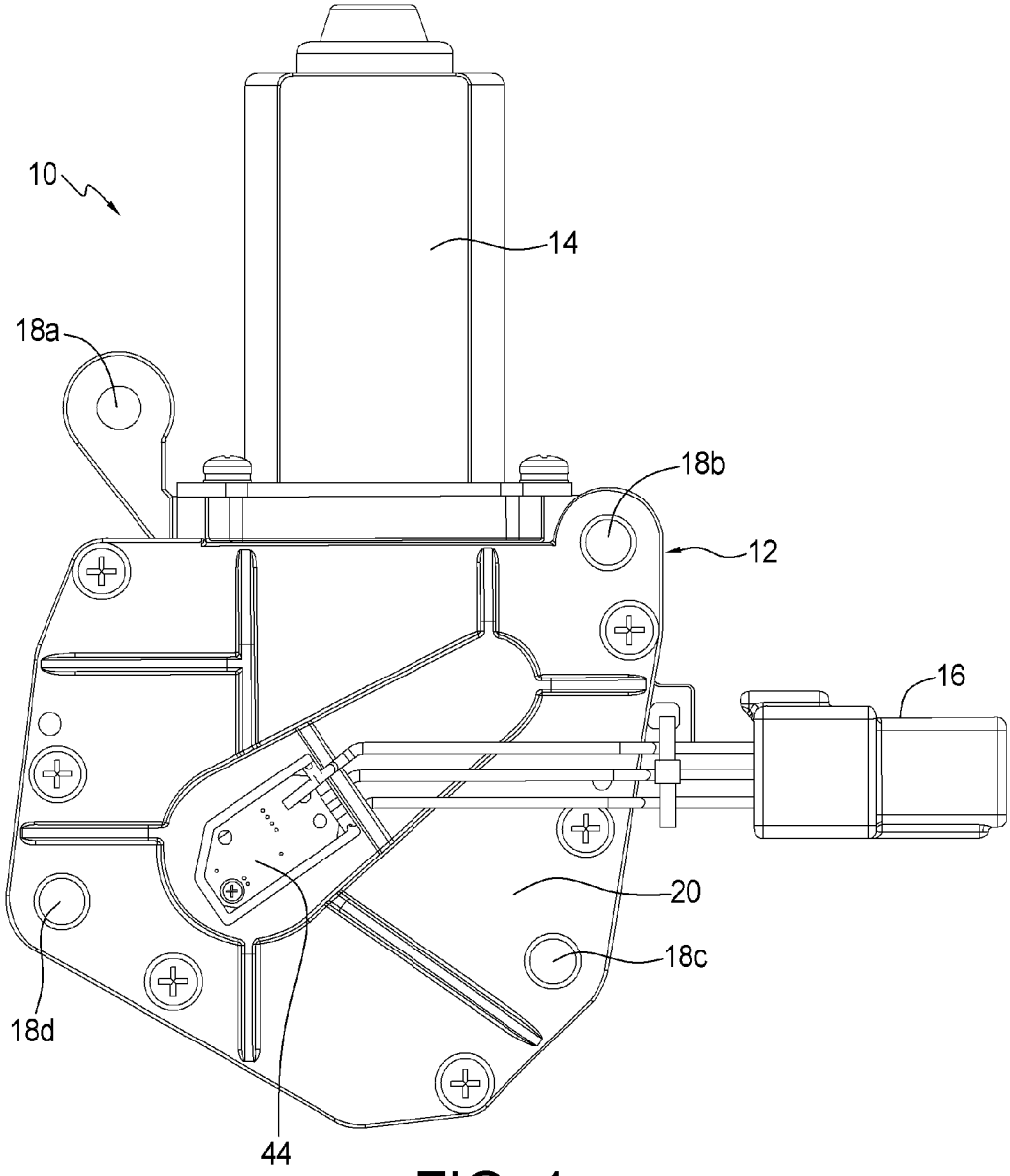
FIG. 1 is a top plan view of a rotary actuator provided with an improved position sensor.
Figure 2:
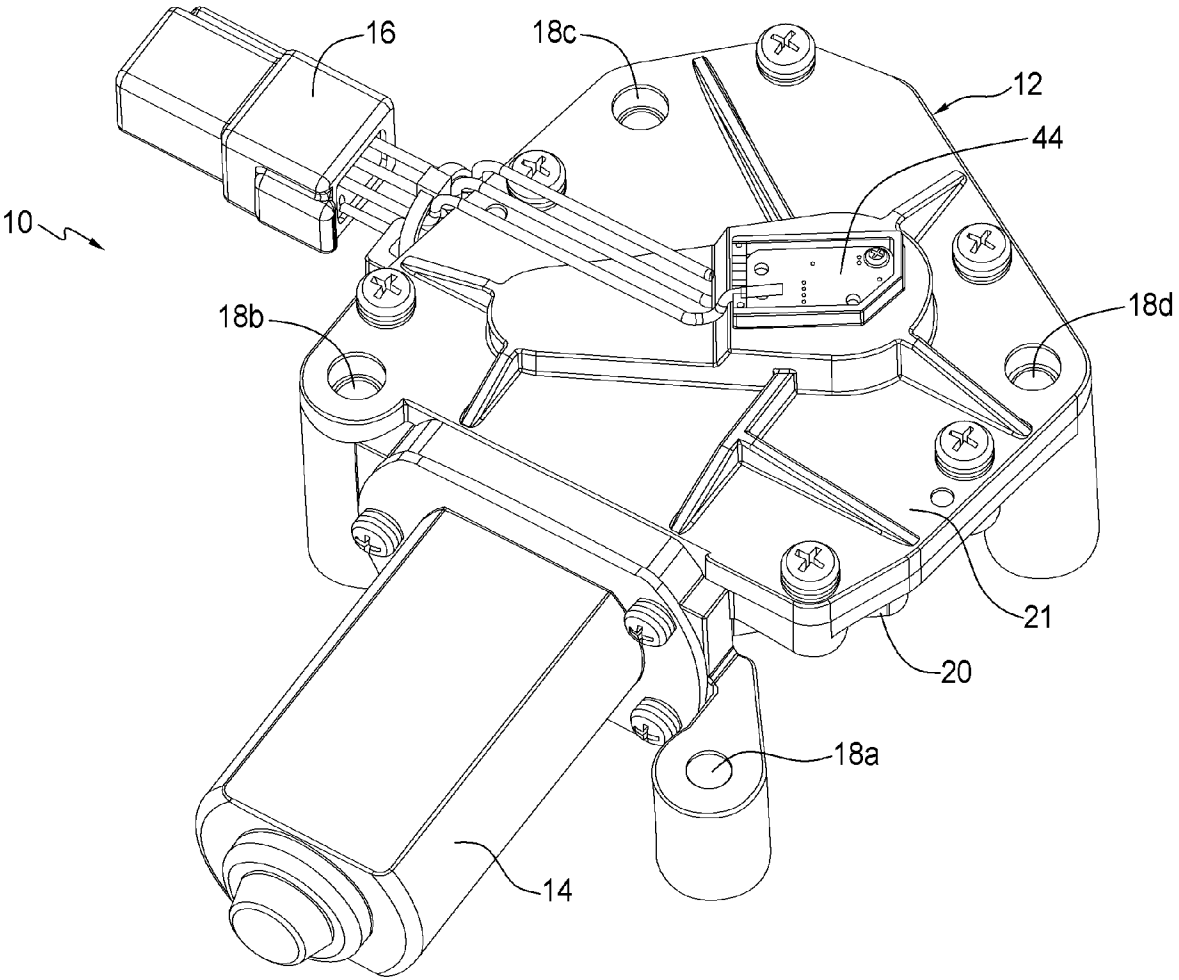
FIG. 2 is a front perspective view of the rotary actuator of FIG. 1.
Figure 3:
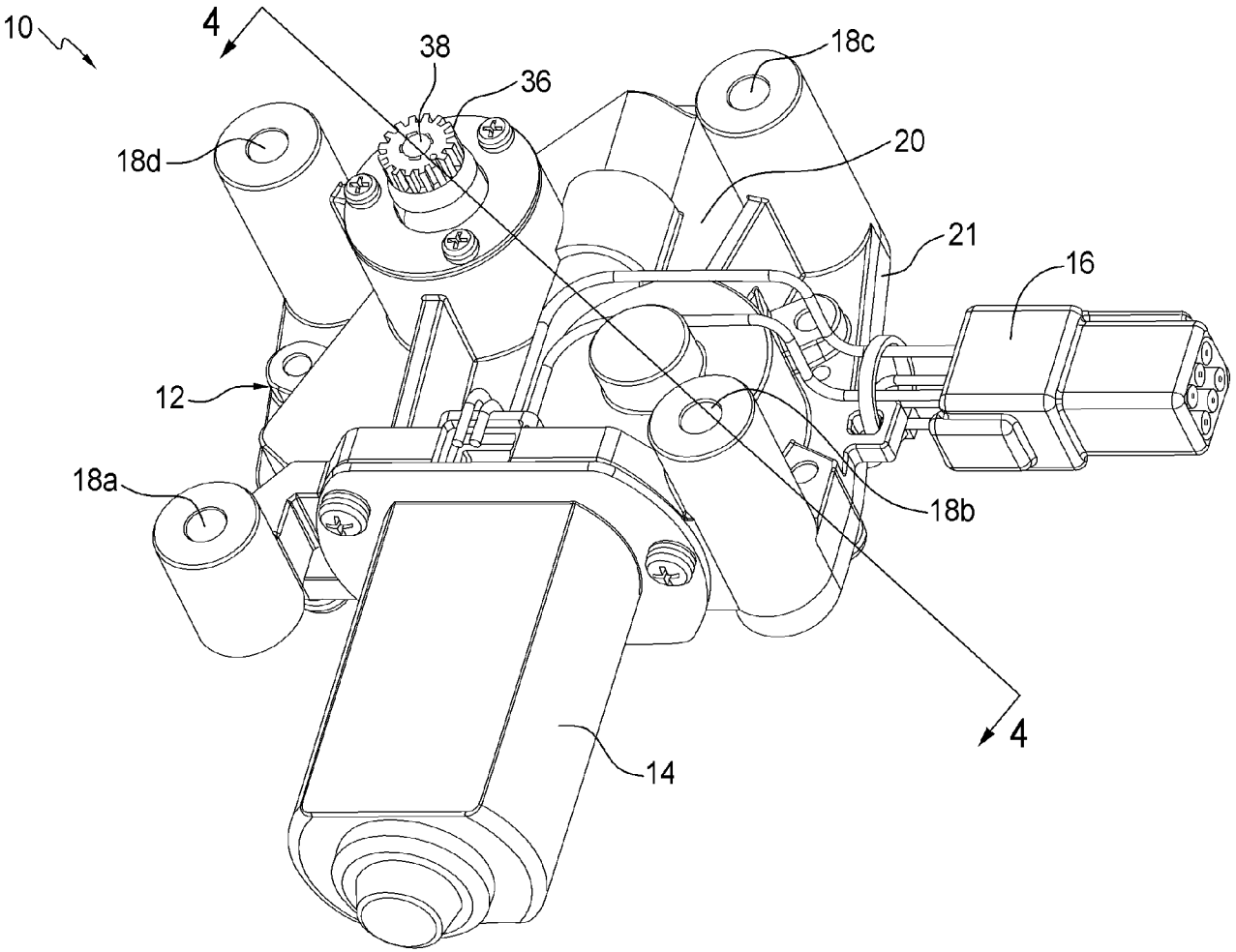
FIG. 3 is a rear perspective view of the rotary actuator of FIG. 1.

Referring to the drawings and first to FIGS. 1 to 3 these show a rotary actuator 10. The rotary actuator 10 generally includes a waterproof housing 12 encasing various components, a motor 14 extending from and bolted to the housing 12, and a harness 16 for electrically connecting the rotary actuator 10 to a control circuit (not shown). The housing 12 is provided with a plurality of mounting holes 18*a*, 18*b*, 18*c*, and 18*d* allowing the actuator 10 to be mounted as needed. In this example, the housing 12 also includes a body 20 and a cover 21 bolted the body 20. Removing the cover 20 provides access to various components encased in the housing 12. The motor 14 may be rotated in either a first direction or a second direction opposite to the first direction depending on the direction of the electric current supplied to the motor 14. As best shown in FIG. 3, the harness 16 wired to the motor 14 supplies an electric current thereto.

Figure 4:
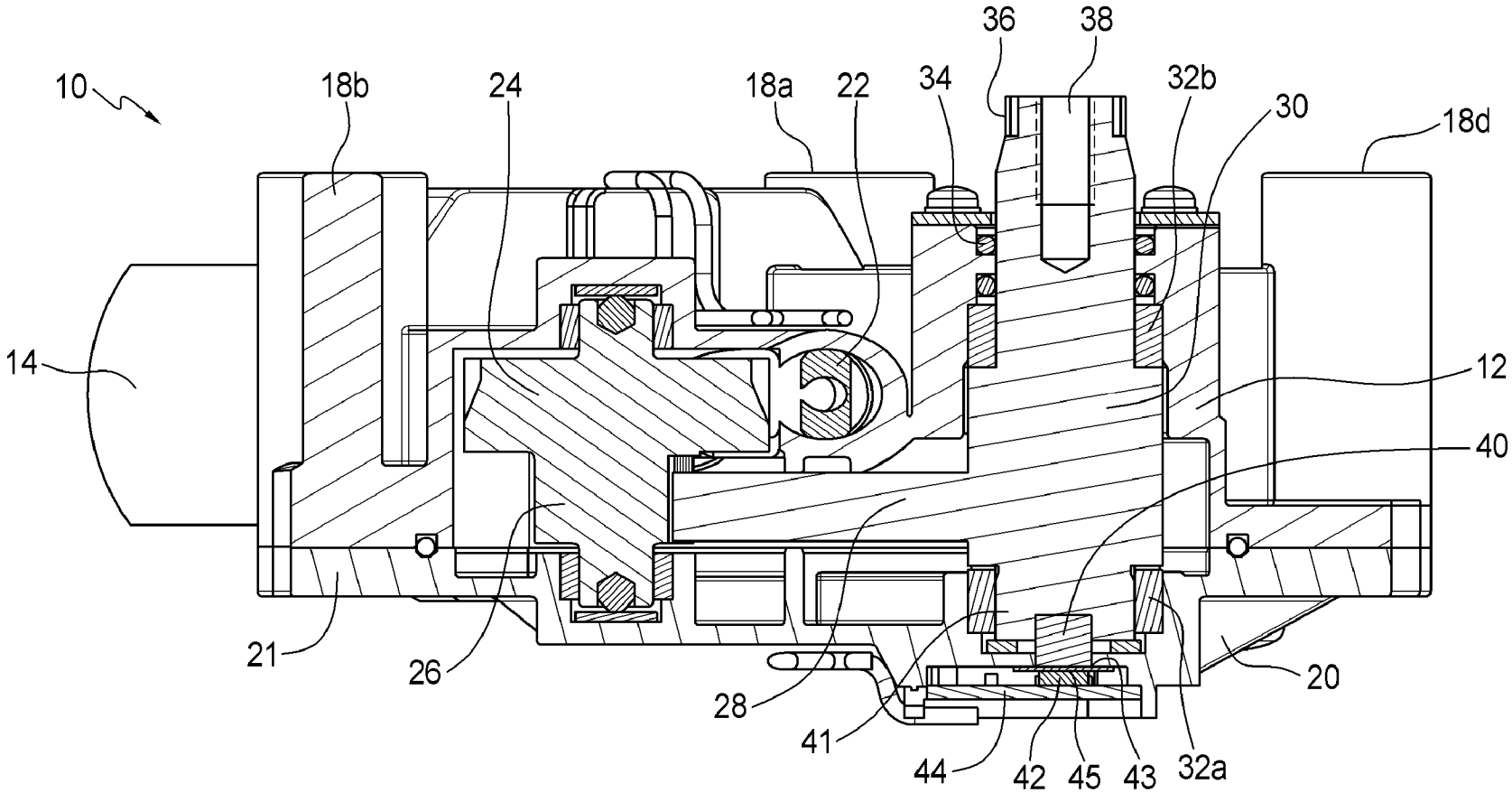
FIG. 4 is a sectional view taken along line 4-4 of FIG. 3.

Referring now to FIG. 4, the housing 12 encases a worm gear 22 which is coupled to an output shaft (not shown) of the motor 14. The worm gear 22 engages a worm wheel 24 which is integrated with a spur gear pinion 26. The worm gear 22 imparts rotary motion to both the worm wheel 24 and spur gear pinion 26. The spur gear pinion 26 imparts rotary motion to a sector spur gear 28 which is integrated with an output shaft 30 of the actuator 10. The output shaft 30 is thereby rotated by the motor 14. Bearings 32*a* and 32*b* are provided between the output shaft 30 and the housing 12 to allow free rotation of the output shaft 30 within the housing 12. A sealing member in the form of an O-ring 34 is provided about the output shaft 30 to seal the housing.

As best shown in FIG. 3, a distal end 36 of the output shaft 30 is splined. There is a longitudinal female threaded aperture 38 extending into the output shaft 30 from the distal end 36 thereof. The aperture 38 is designed to receive a bolt to couple the output shaft 30 to an arm as will be discussed in greater detail below. Accordingly, as thus far described, the actuator 10 is conventional.

However, as best shown in FIG. 4, the actuator 10 disclosed herein further includes a magnet 40 disposed at a proximal end 39 of the output shaft 30. There is also a position sensor 42 which senses a rotating position as a magnet as the output shaft rotates. The sensor is thereby able to sense a rotating position of the output shaft 30. In this example the sensor 42 is a Hall Effect sensor but in other embodiments the sensor may be a magnetoresistive sensor or another suitable magnetic rotational sensor. The sensor 42 is electrically connected to a sensor circuit on a circuit board 44. The circuit board 44 is mounted on the actuator housing 12. More specifically, in this example, the circuit board 44 is mounted on the housing cover 21. As best shown in FIGS. 1 and 2, the circuit board 44 is wired to the harness 16 allowing the rotating position of the output shaft 30 to be relayed from the sensor 42 to the control circuit.

Careful positioning of the magnet 40 relative to the sensor 42 is desired. The distance between the magnet 40 and the sensor 42 is preferably between 0.5 mm and 2.0 mm. A positional tolerance of the output shaft axis is preferably within +/−0.8 mm of the sensor axis. A hole is 43 is provided in the housing cover 21 in order to position the magnet 40 within the preferred distance of the sensor 42. The magnet 40 extends through the hole 53. A polymer tape, e.g. MYLAR® with an adhesive back, seals a circumference of the hole 43 in this example. Potting material (not shown) covering the circuit board 44 may also serve to seal the hole 43. The distance between the magnet 40 and the circuit board 44 is also preferably between 2.2 mm and 3.2 mm. This allows the magnetic field to be in the range of +/−45 mT to +/−75 mT.

It is also undesirable to have material with high relative magnetic permeability external to the actuator 10. In this example, material with a relative magnetic permeability of 100 or higher should not be within a 50 mm radius of the actuator 10. The material that surrounds the magnet 40 and the sensor 42 should have low relative magnetic permeability and, preferably, a relative magnetic permeability of less than 1.1. In this example, the output shaft 30 is made of non-ferromagnetic stainless e.g. grade 304 or 316. The bearing 32*a*, in this example, is made of powder metallurgy composite of copper and graphite, or certain grade of bronze, hat is non-ferromagnetic. The housing 12 is made of casting aluminum, such as AISI 356, AISI 380, ADC 1, ADC10, or ADC12. However, it is possible to use materials which have a relative magnetic permeability of between 1.1 and 1.4 including aluminum, nickel and bronze.

Figure 5:
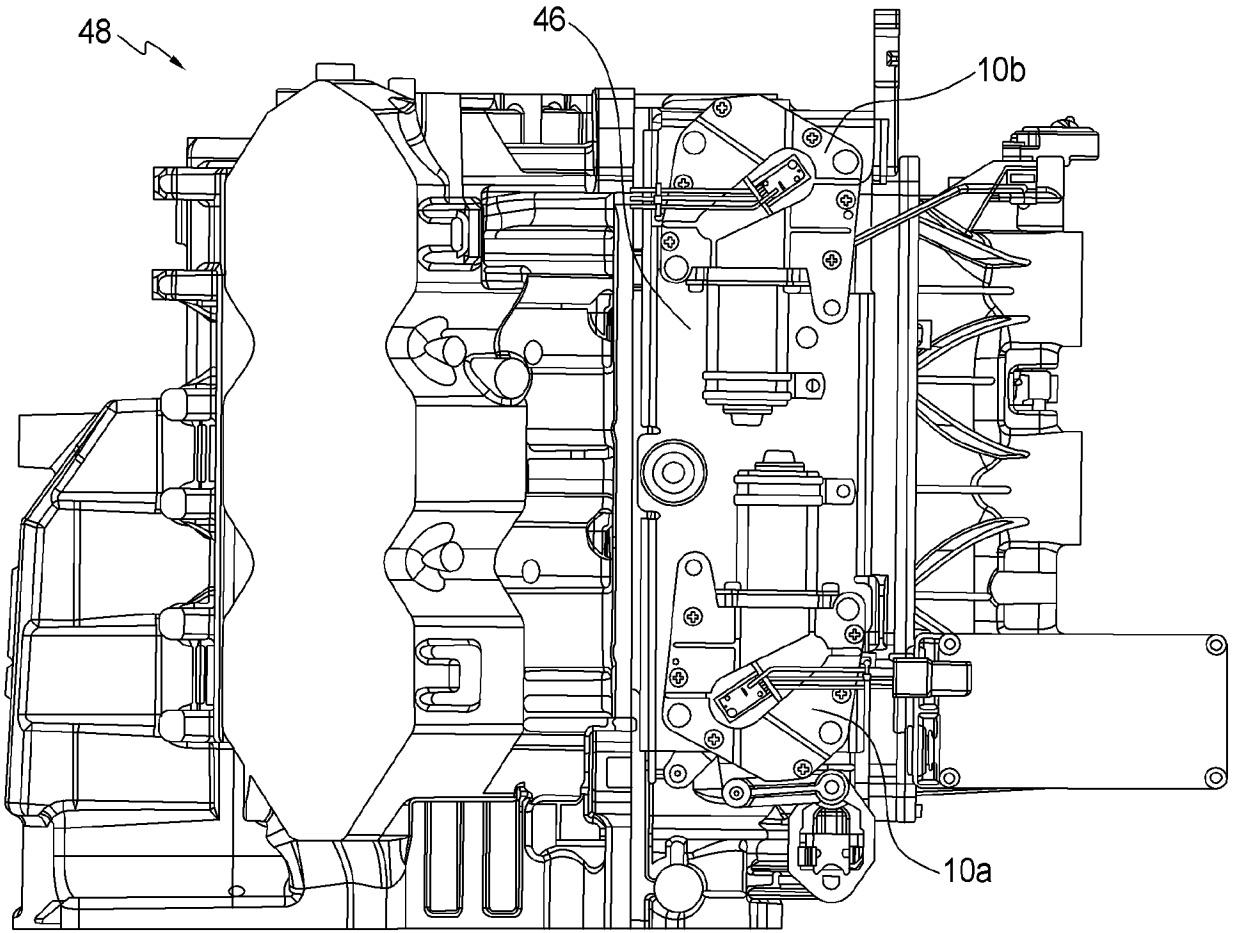
FIG. 5 is a side elevation, partially broken view showing the rotary actuator of FIG. 1 mounted on a outboard engine.
Figure 6:
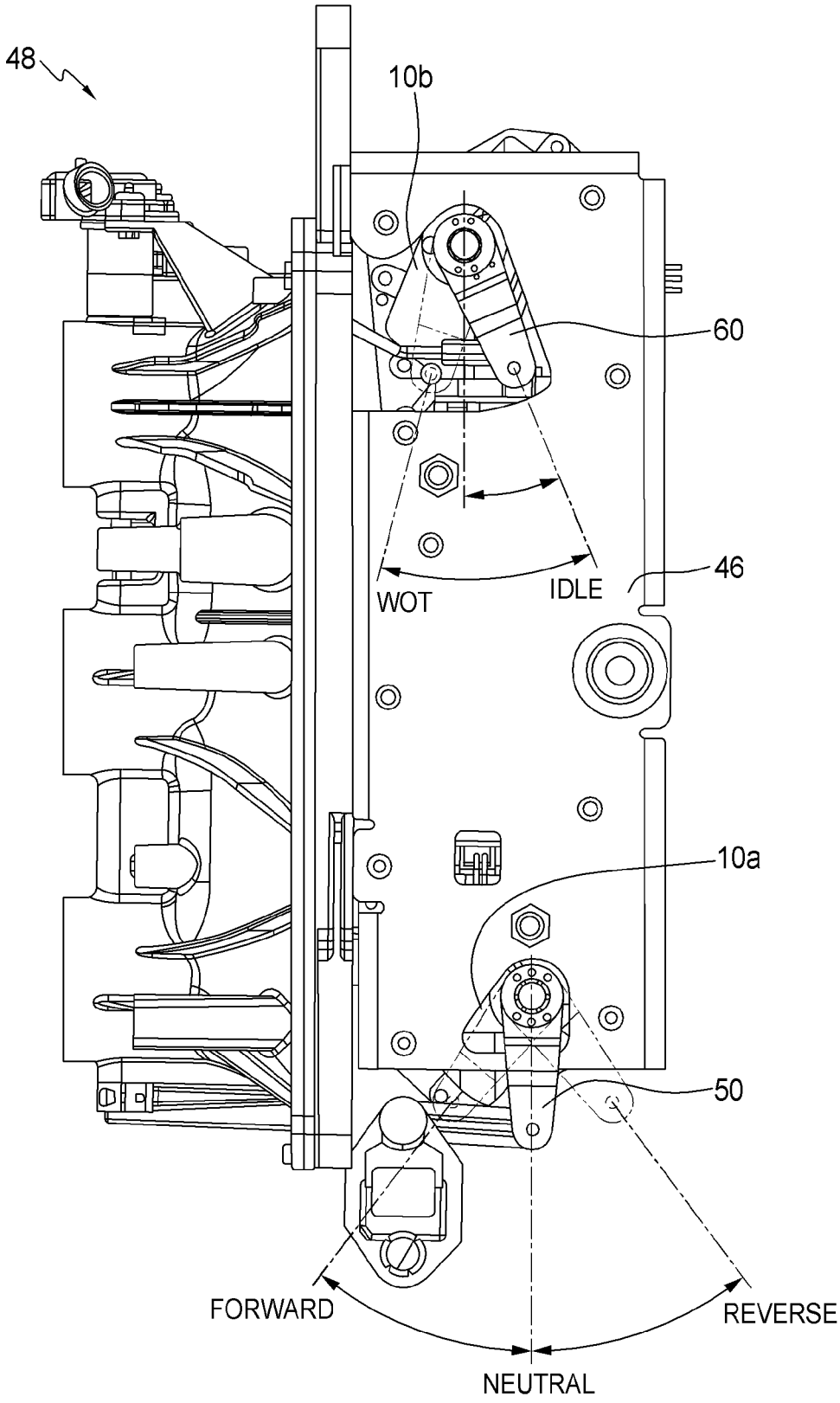
FIG. 6 is a side elevation, partially broken view section showing the rotary actuator of FIG. 1 mounted on an outboard engine.

As shown in FIGS. 5 and 6, the rotary actuator 10 may be mounted on a mounting bracketing 46 of an outboard engine 48 and used as either a shift actuator or a throttle actuator in a shift and throttle system. In FIGS. 5 and 6 a pair of rotary actuators 10*a* and 10*b* are mounted on the mounting bracket 46. The rotary actuators 10*a* and 10*b* are substantially similar having the above described structure and differing only with respect to their arms as will be discussed in greater detail below.

A first one of the rotary actuators 10*a* functions as a shift actuator and a second one of the rotary actuators 10*b* functions as a throttle actuator. As best shown in FIG. 6, a shift arm 50 of the shift actuator 10 is movable between a shift neutral position as shown in solid lines and a shift forward position or a shift reverse position which are shown in ghost. The throttle arm 60 of the throttle actuator 10*b* is movable between an idle position as shown inn solid lines and a wide open throttle (WOT) position as shown in ghost.

Figure 7A:
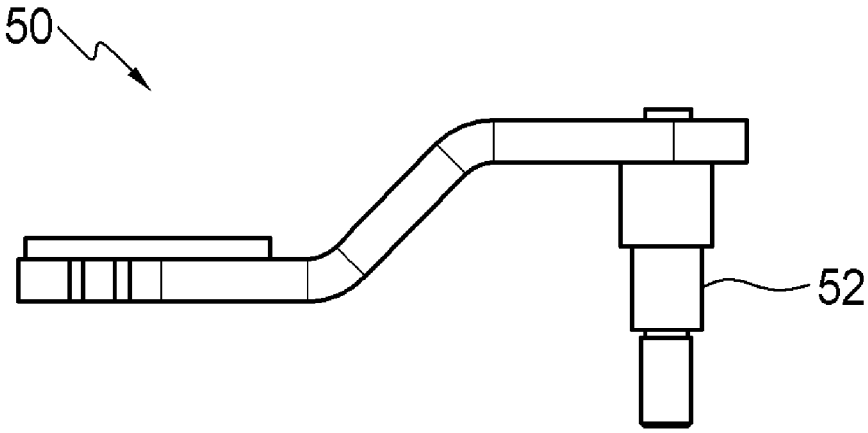
FIG. 7A is a side elevation view of a shift arm which may be coupled to the rotary actuator of FIG. 1.
Figure 7B:
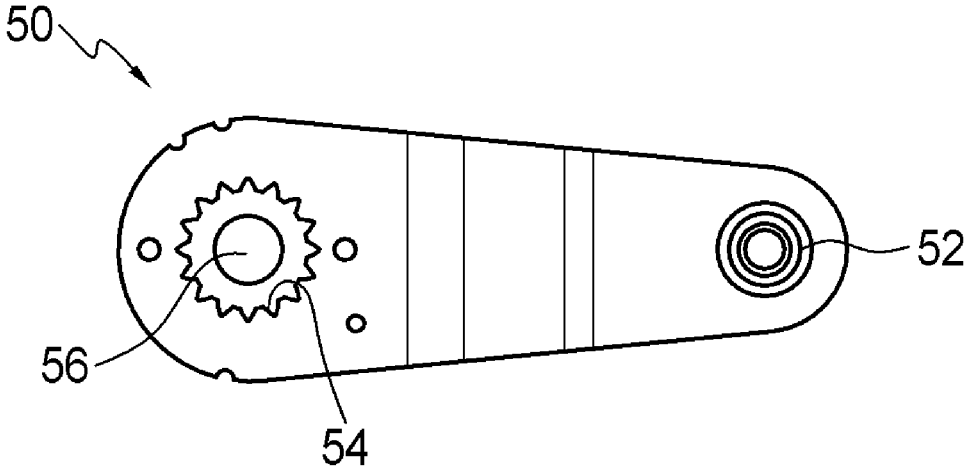
FIG. 7B is a bottom plan view of a the shift arm of FIG. 7A.

The shift arm 50 is best shown in FIGS. 7A and 7B. The shift arm 50 has a step graduated pin 52 for coupling the shift arm 50 the outboard engine 48. The graduated pin reduces friction at the linkage point between the shift arm 50 and the outboard engine 48. The shift arm also has a splined socket 54 for engaging the distal splined end 36 of the output shaft 30. This prevents rotation of the shift arm relative to the output shaft 30. There is also an aperture 56 extending through the splined socket 64. This allows a bolt to extend through the socket 64 and into the longitudinal aperture 38 of the output shaft 30 thereby securing the shift arm 50 to the output shaft 30.

Figure 8A:
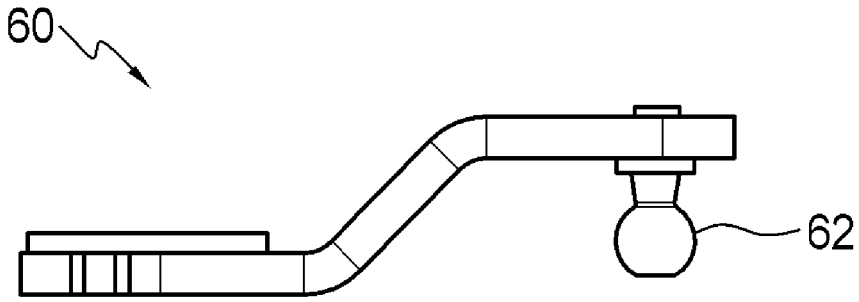
FIG. 8A is a side elevation view of a throttle arm which may be coupled to the rotary actuator of FIG. 1.
Figure 8B:
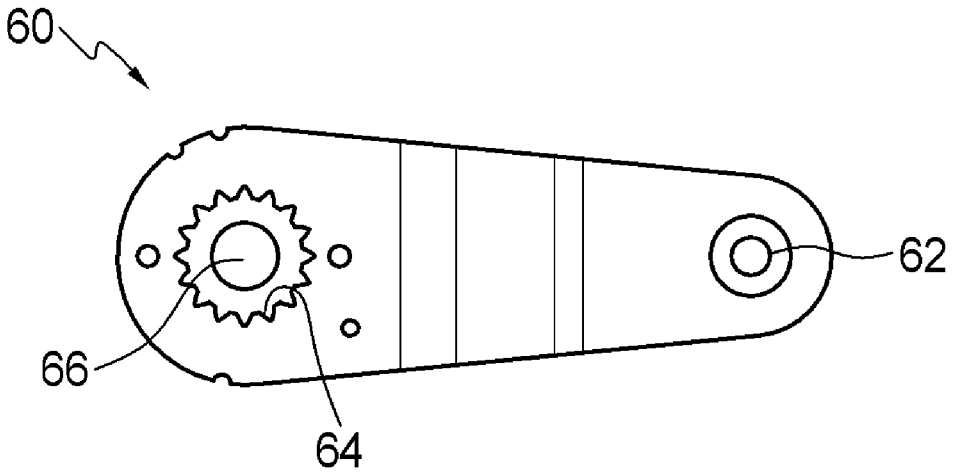
FIG. 8B is a bottom plan view of the shift arm of FIG. 8A.

The throttle arm 60 is best shown in FIGS. 8A and 8B. Similar to the shift arm 50 the throttle arm 60 has a splined socket 64 and aperture 66 extending therethrough. The splined socket 64 and aperture 66 serve the same function as described above. The throttle arm 60 differs from the shift arm 50 in that it is provided with a bearing stud 62 to for engaging a socket of a ball joint as is standard for throttle arms.

In operation, the printed circuit board 44 determines the position of the output arm (either shift arm 50 or throttle arm 60) based on the rotation of the output shaft 30 as determined by the position of the magnet 40 by the sensor 42. The circuit board 44 signals the control circuit to operate the motor 14 as required based on the position of the output arm. Sensing the position of the output shaft reduces, or may even eliminate, backlash which may occur when the position of linked components such as gears are used to determine the position of the output arm.

It will further be understood by a person skilled in the art that many of the details provided above are by way of example only, and are not intended to limit the scope of the invention which is to be determined with reference to following claims.

What is claimed is:

1. A rotary actuator comprising:

a housing;

an output shaft extending from the housing;

an actuator arm coupled to the output shaft;

a magnet disposed at an end of the output shaft;

a motor coupled to the output shaft for rotating the output shaft; and a position sensor for sensing a rotational position of the magnet as the output shaft rotates, wherein an axis of the position sensor is substantially co-axial with an axis of the output shaft and the position sensor is electrically coupled to a sensor circuit and the sensor circuit determines a rotational position of the output shaft and a position of the actuator arm based on the rotational position of the output shaft.

2. The rotary actuator as claimed in claim 1 wherein the magnet is disposed at an end of the output shaft opposite the actuator arm.

3. The rotary actuator as claimed in claim 1 wherein the magnet extends through a hole in the housing.

4. The rotary actuator as claimed in claim 3 wherein a polymer tape seals a circumference of the hole in the housing.

5. The rotary actuator as claimed in claim 1 further including a harness for electrically coupling the sensor circuit to a control circuit.

6. The rotary actuator as claimed in claim 1 wherein the distance between the magnet and the position sensor is between 0.5 mm and 2.0 mm.

7. The rotary actuator as claimed in claim 1 wherein the position sensor is mounted on a circuit board.

8. The rotary actuator as claimed in claim 7 wherein the distance between the magnet and the circuit board is between 2.2 mm and 3.2 mm.

9. The rotary actuator as claimed in claim 1 wherein the output shaft is formed from a material having a relative magnetic permeability of less than 1.4.

10. The rotary actuator as claimed in claim 1 wherein the housing is formed from a material having a relative magnetic permeability of less than 1.4.

11. The rotary actuator as claimed in claim 1 wherein the actuator is a shift actuator.

12. The rotary actuator as claimed in claim 1 wherein the actuator is a throttle actuator.

13. The rotary actuator as claimed in claim 1 wherein the axis of the position sensor is within +/−0.8 mm of the axis of the output shaft.

14. A shift actuator comprising:

a housing;

an output shaft extending from the housing;

an actuator arm coupled to the output shaft;

a magnet disposed at an end of the output shaft opposite the actuator arm;

a motor coupled to the output shaft for rotating the output shaft; and a position sensor for sensing a rotational position of the magnet as the output shaft rotates, wherein an axis of the position sensor is substantially co-axial with an axis of the output shaft and the position sensor is electrically coupled to a circuit board and the circuit board determines a rotational position of the output shaft and a position of the actuator arm based on the rotational position of the output shaft.

15. The shift actuator as claimed in claim 14 wherein the magnet extends through a hole in the housing.

16. The shift actuator as claimed in claim 15 wherein a polymer tape seals a circumference of the hole in the housing.

17. The shift actuator as claimed in claim 14 further including a harness for electrically coupling the circuit board to a control circuit.

18. The shift actuator as claimed in claim 14 wherein the axis of the position sensor is within +/−0.8 mm of the axis of the output shaft.

19. A throttle actuator comprising:

a housing;

an output shaft extending from the housing;

an actuator arm coupled to the output shaft;

a magnet disposed at an end of the output shaft opposite the actuator arm;

a motor coupled to the output shaft for rotating the output shaft;

a position sensor for sensing a rotational position of the magnet as the output shaft rotates, wherein an axis of the position sensor is substantially co-axial with an axis of the output shaft and the position sensor is electrically coupled to a circuit board and the circuit board determines a rotational position of the output shaft and a position of the actuator arm based on the rotational position of the output shaft.

20. The throttle actuator as claimed in claim 19 wherein the magnet extends through a hole in a housing.

21. The throttle actuator as claimed in claim 20 wherein a polymer tape seals a circumference of the hole in the housing.

22. The throttle actuator as claimed in claim 20 further including a harness for electrically coupling the circuit board to a control circuit.

23. The throttle actuator as claimed in claim 19 wherein the axis of the position sensor is within +/−0.8 mm of the axis of the output shaft.

* * * * *